US005517888A

United States Patent [19]

Ray

[11] Patent Number: 5,517,888

[45] Date of Patent: May 21, 1996

[54] CUTTING APPARATUS

[75] Inventor: Stephen Ray, Waterlooville, United Kingdom

[73] Assignee: Chemring Limited, Hampshire, United Kingdom

[21] Appl. No.: 253,952

[22] Filed: Jun. 3, 1994

[30] Foreign Application Priority Data

Jun. 4, 1993 [GB] United Kingdom ..... 9311609

[51] Int. Cl.[6] ..... B26F 1/44

[52] U.S. Cl. ..... 83/140; 83/620

[58] Field of Search ..... 83/140, 143, 137, 83/138, 139, 141, 620

[56] References Cited

U.S. PATENT DOCUMENTS

| | | | |
|---|---|---|---|
| 1,419,276 | 6/1922 | Lentz | 83/140 |
| 2,325,290 | 7/1943 | Wales | 83/140 |
| 3,611,854 | 10/1971 | Gilev et al. | 83/140 |
| 3,783,724 | 1/1974 | Uhlig | 83/140 |
| 3,949,631 | 4/1976 | Goldman et al. | 83/98 |
| 4,742,746 | 5/1988 | Olsson | 83/140 |
| 4,905,556 | 3/1990 | Haack et al. | 83/137 |
| 5,253,559 | 10/1993 | Philippe et al. | 83/138 |

*Primary Examiner*—Kenneth E. Peterson

*Attorney, Agent, or Firm*—Wood, Phillips, VanSanten, Clark & Mortimer

[57] ABSTRACT

An apparatus (10) for cutting multiple strands of material such as radar reflective chaff comprises at least one movable knife blade (36) with a series of ejector pins (26) which lightly contact the material surface during cutting and a stripper plate (40) which is pressed against the material surface for holding the material during cutting. During cutting, the ejector pins (26) and stripper plate (40) are moved into contact with the material, the blade or blades (36) then cut through the material and the pins (26) and plate (40) are retained in contact with the cut material whilst the or each blade is withdrawn from the cut material.

12 Claims, 3 Drawing Sheets

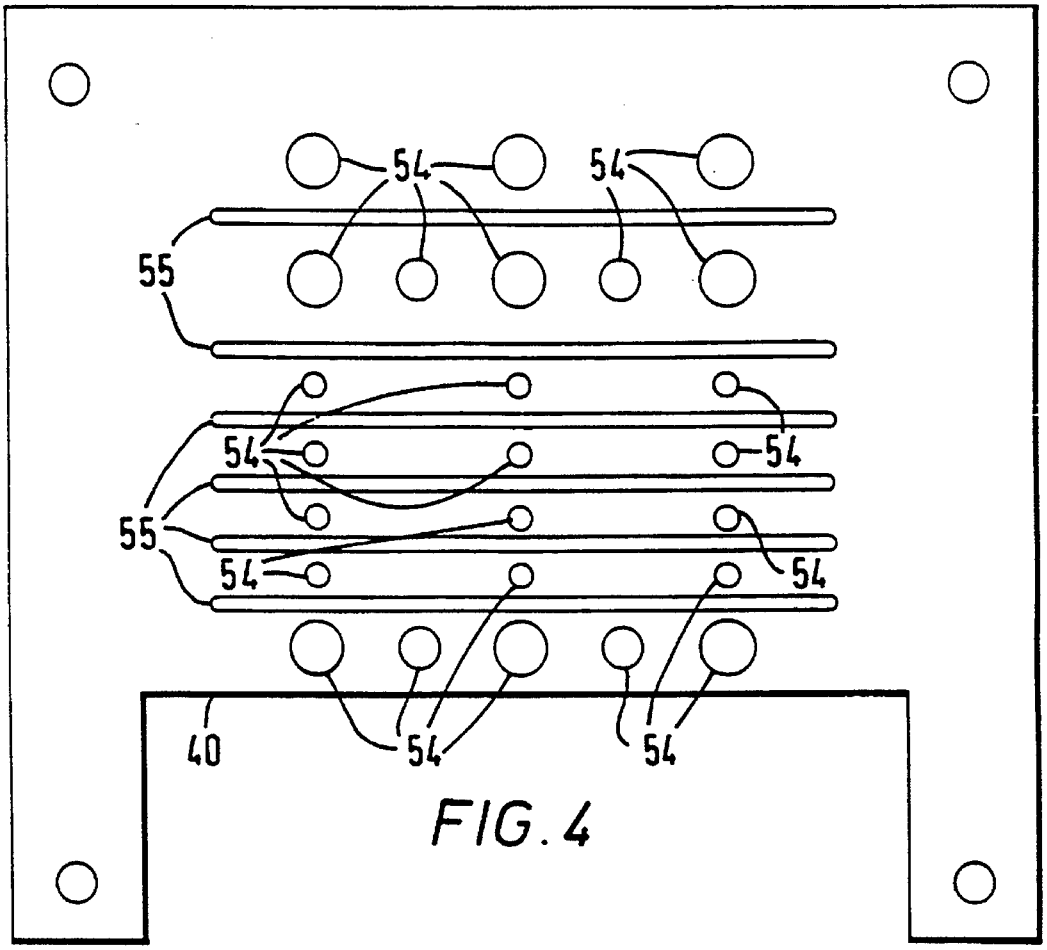
FIG. 4
FIG. 5
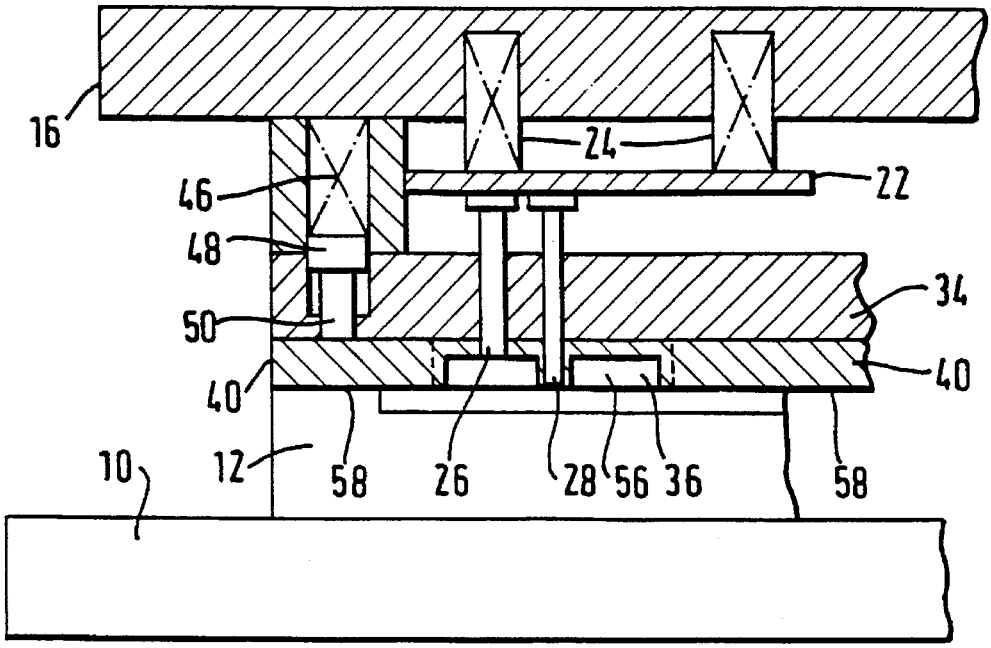

CUTTING APPARATUS

The invention relates to cutting apparatus and particularly to cutting apparatus for cutting multiple strands of material such as strands of radar reflective chaff.

Chaff is used principally in military applications as a counter-measure against radar-homing missiles. The chaff is fired in defence forming a large radar image. The guidance system of an incoming missile is confused by this image long enough for it to miss its intended target.

Chaff is made from millions of strands of material with a radar-reflective coating, for example, metal-coated glass fibre filaments. The strands are usually of several different lengths in order to reflect radar of different frequencies and thereby affect a greater band width of radar signals. In order to achieve this variable length, strands of uniform length are produced and then cut to size. Cutting of these strands has proved difficult since they are extremely fine and cutting in conventional manner by means of a guillotine blade can result in distortion of the strands by the blade during the cutting action which can cause an inaccurate cut.

It is an object of the invention to provide an improved form of cutting apparatus.

According to the invention there is provided a cutting apparatus, for cutting material such as chaff, the apparatus comprising at least one movable cutting blade and holding means for holding material being cut, the holding means being movable relative to the or each cutting blade whereby, in use during cutting, the holding means may be moved into contact with material being cut and may then be retained in contact with the cut material whilst the or each cutting blade is withdrawn from the cut material.

By engaging the cut material during retraction of the or each blade, the holding means reduces the distortion of the material to produce a more accurate cut.

Preferably there is a plurality of cutting blades mounted in fixed relation to a mounting plate and located between the mounting plate and the holding means.

The holding means may comprise a stripper plate which is resiliently mounted both in relation to the cutting blades and to the mounting plate.

The apparatus may also include an ejector pin, arranged to contact the material during cutting and to maintain contact until after the stripper plate has been withdrawn from the material. The pin is suitably resiliently mounted in relation to the cutting blades. Preferably the ejector pin is arranged so that it extends to such a position that, in use, it engages the material to be cut before the stripper plate. In a preferred arrangement there is a plurality of ejector pins which extend through corresponding apertures in the stripper plate from a backing plate resiliently mounted to the mounting plate and located between the cutting blades and the mounting plate.

Where the holding means comprises a stripper plate, slots may be provided through which the cutting blades can pass, in use.

In a preferred embodiment at least one stop pin is provided, the or each stop pin being movably mounted in relation to the cutting blades. The or each stop pin is preferably resiliently mounted and may be mounted on a stop backing plate resiliently mounted to the mounting plate. Suitably, the backing plate is the backing plate on which are also mounted the ejector pin or pins. The or each stop pin is arranged to extend beyond the ejector pin or pins and, in use, engages a cutting surface on which the material is to be cut.

In a preferred embodiment, lateral restraining means for restricting lateral movement of the material during cutting is provided.

The stripper plate may include a recess having side edges, the recess being arranged to contact the material to be cut, in use, whereby the side edges comprise the aforesaid lateral restraining means. A plurality of such recesses may be provided.

According to another aspect of the invention a method for cutting material comprises the steps of introducing the material to be cut to a cutting surface, holding the material against the surface with holding means, cutting the material with cutting means, withdrawing the cutting means from the material while still holding the material and then withdrawing the holding means to allow removal of the cut material.

Preferably the step of holding the material against the surface comprises moving the holding means into engagement with the material so that the material is held against the surface.

The step of holding the material against the surface may comprise moving ejector pins into engagement with the material so that the material is held lightly against the surface then moving a stripper plate into engagement with the material so that the material is held firmly against the surface for the cutting action. In this arrangement the ejector pins are withdrawn after the stripper plate has been withdrawn from the material.

Preferably the step of holding the material against the surface comprises moving stop pins into engagement with the surface on which the material is to be cut, moving ejector pins into engagement with the material so that the material is held lightly against the surface, and moving a stripper plate into engagement with the material so that the material is held firmly against the surface.

A cutting apparatus in accordance with the invention will now be described in detail by way of example with reference to the accompanying drawings in which:

FIG. 4 is a plan view of the stripper plate of the apparatus; and,

FIG. 5 is an end elevation of the apparatus of FIG. 3 shown in the mid-cut position.

Figure 1:
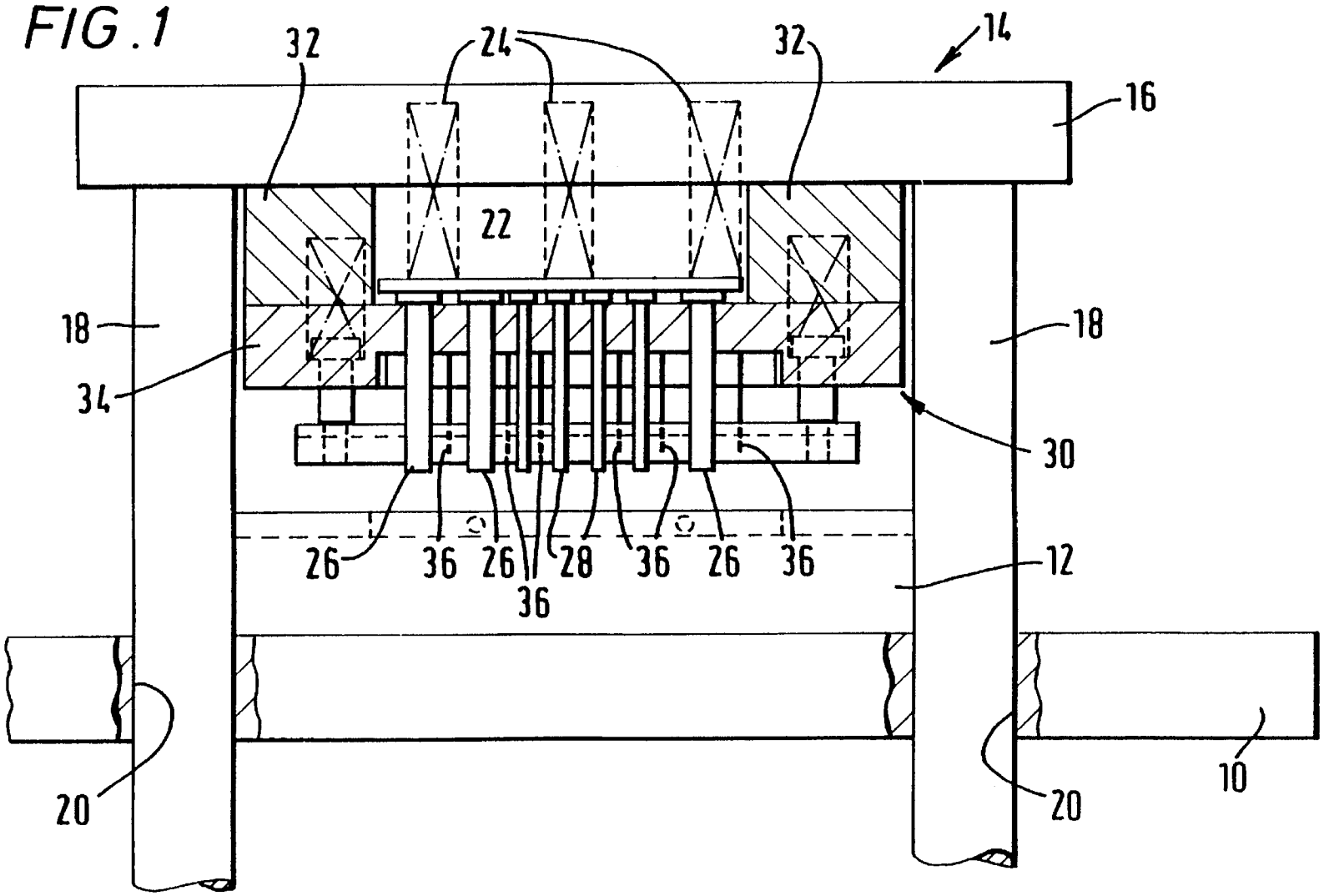
FIG. 1 is a side elevation of a cutting apparatus in accordance with the invention.
Figure 2:
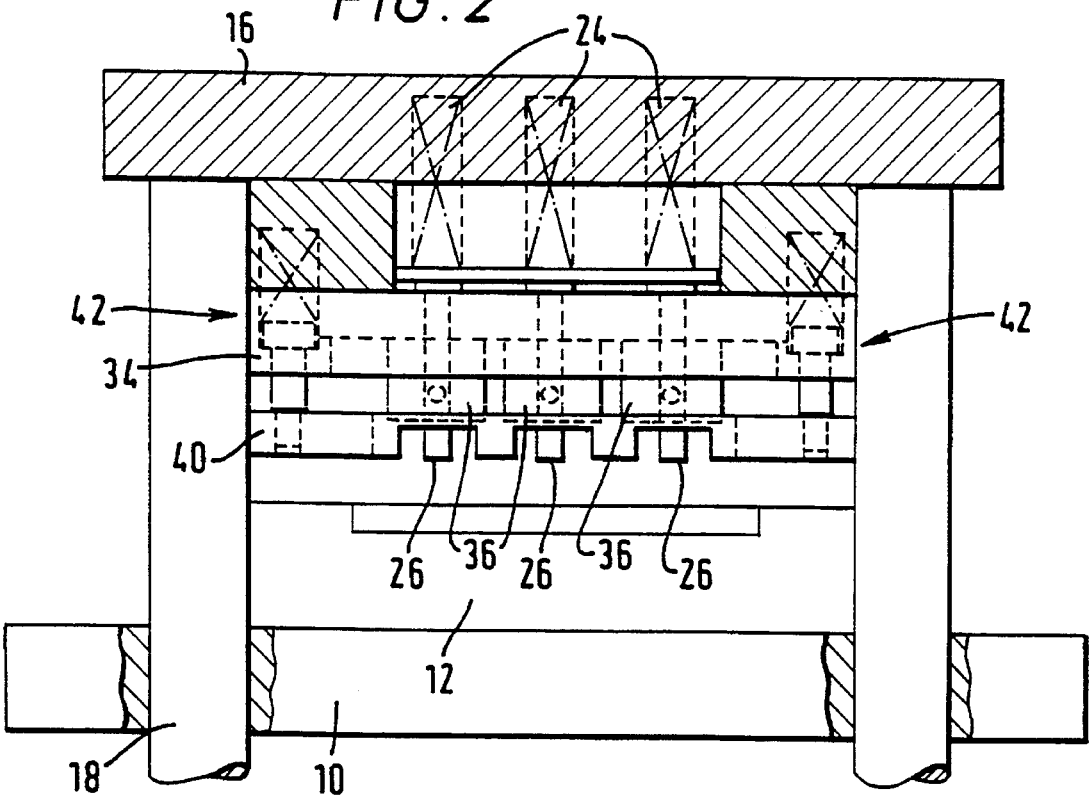
FIG. 2 is an end elevation of the apparatus of FIG. 1.
Figure 3:
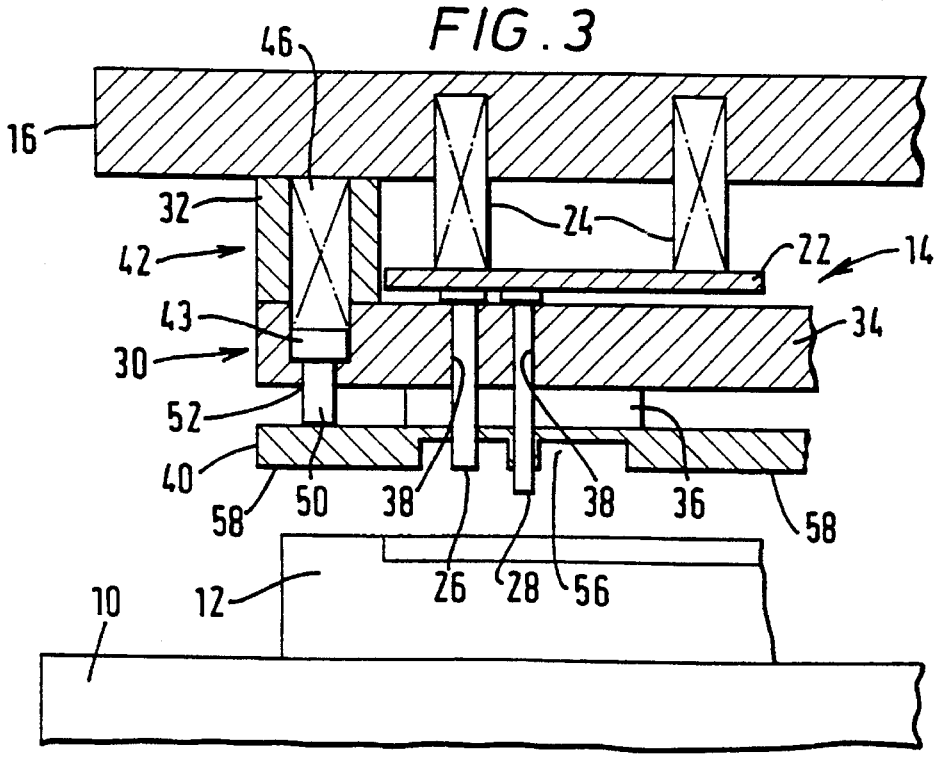
FIG. 3 is an elevation of part of the apparatus of FIGS. 1 and 2 shown to a larger scale and with some parts omitted for clarity.

In the drawing a cutting apparatus of FIGS. 1 to 3 comprises a base (10), a cutting surface (12) arranged on the base (10) and a cutting assembly indicated generally at (14) disposed spaced from the cutting surface (12).

The cutting assembly (14) includes a top plate (16) mounted on bars (18) so as to be parallel and spaced from the base (10). The bars (18) extend perpendicularly from the top plate (15) through apertures (20) in the base (10). A backing plate (22) is resiliently mounted parallel to the top plate (16) by means of springs (24). Mounted on a face of the backing plate (22) and projecting perpendicularly away from the top plate (16) is a plurality of ejector pins (25) and stop pins (28).

A blade assembly (30) is rigidly mounted to the top plate (16) by means of blocks (32). The blade assembly (30) comprises a blade carrier (34) in the form of a plate mounted to the blocks (32) and being disposed substantially parallel to the base (10). Extending perpendicularly from the blade carrier (34) are several spaced, parallel knife blades (36). The blade assembly (30) is located between the backing plate (22) and the base (10) and a plurality of apertures (38) are provided in the blade carrier (34) in order to allow the ejector and stop pins (25,28) to extend therethrough.

A stripper plate (40) (see particularly FIG. 4) is resiliently mounted in relation to the top plate (16) by means of spring-loaded pistons (42) disposed in bores (44) in the blocks (32). Each piston (42) comprises a spring (46), a piston head (48) and a piston rod (50). The piston rod (50) extends slidably through an aperture (52) in the blade carrier (34) and is attached to the stripper plate (40). The stripper plate (40) is located between the blade carrier (34) and the base (10) and is parallel thereto. The stripper plate (40) has a central recess for retaining the chaff material during cutting as will be explained and also includes apertures (54) through which the ejector and stop pins (26,28) extend and slots through which the blades (36) can pass, in use.

The ejector pins (26) and stop pins (28) extend from the backing blade (22), through the apertures (38,54) in the blade carrier (34) and the stripper plate (40) respectively, to a position beyond a plane containing the face of the stripper plate (40) spaced furthest from the top plate (16).

In use, lengths of juxtaposed wrapped chaff material are fed from one end of the cutting apparatus (for example the right in FIG. 1) onto the cutting surface (12) and stopped below the cutting assembly (14). The cutting assembly (14) is then moved towards the base (10). The movement of the cutting assembly firstly causes the stop pins (28) to abut the cutting surface (12) and the ejector pins (26) rest lightly on the chaff material. Continued downward movement of the cutting assembly (14) causes the central recess (56) of the stripper plate (40) to contact the chaff material and the side edges (58) of the stripper plate to contact the cutting surface where it protrudes laterally of the chaff material. The stripper plate (40) holds the chaff material firmly in place by means of the spring-loaded pistons (42). Further movement of the cutting assembly (14) towards the base (10) causes the blades (36) to move through the slots (55) and to cut through the chaff material. As the top plate (34) moves towards the base (10), the springs (24,26) which mount the backing plate (22) and the stripper plate (40) respectively to the top plate (16), are compressed and thus the sheet of material is held down very firmly while cutting occurs. FIG. 5 shows the system of FIG. 3 in mid-cut.

When the blades (36) have cut through the sheet of material, the process is reversed. The blades (36) are withdrawn from the material as the top plate (16) moves away from the base (10) and the stripper plate (40) holds the chaff material firmly in position. When the blades (36) are fully withdrawn, continued movement of the top plate (16) away from the base (10) causes the stripper plate (40) and subsequently the ejector pins (26) and stop pins (28) to be withdrawn from the sheet and cutting surface (12).

This operation means that the material is held down firmly throughout the cutting operation, which allows an accurate cut and reduces loss of material.

The movement of the cutting assembly (14) can be effected by any conventional means, for example, hydraulically. It will also be appreciated that the cutting action may be effected by moving the base (10) and cutting surface (12) towards the cutting assembly (14).

Once the lengths of chaff have been cut, the cut lengths are moved from the cutting edge and new material introduced to allow increased production rates.

The apparatus of the present invention is particularly useful in cutting chaff material for use in the chaff container disclosed in European Patent application No. 506634.

Furthermore, although the apparatus is particularly adapted to cutting filamentary material such as chaff, it is envisaged that it could be used to cut any material, such as carbon fibre or Kevlar, or other materials which are difficult to handle during cutting.

I claim:

1. A cutting apparatus for cutting material the apparatus comprising:

a mounting plate, a plurality of movable cutting blades fixed relative to the mounting plate, a stripper plate for holding material being cut and defining a plurality of apertures, a backing plate resiliently mounted to the mounting plate and located between the cutting blades and the mounting plate, and a plurality of ejector pins extending from the backing plate through corresponding apertures in the stripper plate, the stripper plate being movable relative to the cutting blades whereby, in the use during cutting, the stripper plate may be moved into contact with material being cut and may then be retained in contact with the cut material whilst the blades are withdrawn from the cut material, the ejector pins being arranged to contact the material during cutting and to maintain contact until after the stripper plate has been withdrawn from the material.

2. A cutting apparatus according to claim 1 in which the cutting blades are mounted between the mounting plate and the stripper plate, the stripper plate defining a plurality of slots through which the blades can pass, in use.

3. A cutting apparatus according to claim 1 in which the stripper plate is resiliently mounted in relation to the cutting blades and the mounting plate.

4. A cutting apparatus according to claim 1 in which the ejector pins extend to such positions that in use they engage the material to be cut before the stripper plate.

5. A cutting apparatus according to claim 1 in which the stripper plate includes lateral restraining means for restricting lateral movement of the material during cutting.

6. A cutting apparatus according to claim 5 in which the stripper plate includes a recess having side edges, the recess being arranged in use to receive the material to be cut, the side edges comprising the lateral restraining means.

7. A cutting apparatus according to claim 6 in which the stripper plate includes a plurality of recesses.

8. A cutting apparatus for cutting material, the apparatus comprising:

a mounting plate, a plurality of cutting blades mounted in fixed relation to the mounting plate, holding means for holding material being cut, a stop backing plate resiliently mounted to the mounting plate, a plurality of stop pins mounted on the stop backing plate and an ejector pin extending from the stop backing plate, the cutting blades being located between the mounting plate and the holding means, the holding means being movable relative to the cutting blades whereby, in use during cutting, the holding means may be moved into contact with material to be cut and may then be retained in contact with the cut material whilst the cutting blades are withdrawn from the cut material, and the ejector pin being arranged to contact the material during cutting.

9. A cutting apparatus according to claim 8 in which the stop pins are arranged to extend beyond the ejector pin and, in use, to engage a cutting surface on which the material is to be cut.

10. A cutting apparatus according to claim 8 in which the holding means includes lateral restraining means for restricting lateral movement of the material during cutting.

11. A cutting apparatus according to claim 10 wherein the holding means comprises a stripper plate which includes a recess having side edges, the recess, in use, being arranged to receive the material to be cut whereby the side edges comprise the lateral restraining means.

12. A cutting apparatus according to claim 11 in which the stripper plate includes a plurality of recesses.

* * * * *